United States Patent [19]

Kang

[11] Patent Number: 4,633,605

[45] Date of Patent: Jan. 6, 1987

[54] ASSEMBLY OF TAG PINS WITH A CAP AVOIDING AN ENTWINEMENT BETWEEN HEADS

[76] Inventor: Young W. Kang, c/o K & K Associated Co., C.P.O. Box 2378, Seoul, Rep. of Korea

[21] Appl. No.: 735,506

[22] Filed: May 20, 1985

[30] Foreign Application Priority Data

Jun. 2, 1984 [KR] Rep. of Korea ..... 84-5244[U]

[51] Int. Cl.[4] ..... G09F 3/12

[52] U.S. Cl. ..... 40/24; 40/20 R; 206/343; 206/820; 24/150 FP

[58] Field of Search ..... 40/20 R, 24, 21 R; 206/340, 341, 342, 343, 820, 821; 24/150 FP, 150 B, 298, 72.7

[56] References Cited

U.S. PATENT DOCUMENTS

| | | | |
|---|---|---|---|
| 1,278,130 | 9/1918 | Freeman | 206/341 |
| 2,825,162 | 3/1958 | Flood | 206/820 |
| 3,180,489 | 4/1965 | McGinn | 206/340 |
| 3,278,107 | 10/1966 | Rygg | 206/340 |
| 3,733,657 | 5/1973 | Lankton | 40/24 |
| 4,146,130 | 3/1979 | Samuels et al. | 206/340 |
| 4,172,523 | 10/1979 | Weglage | 206/343 X |
| 4,282,630 | 8/1981 | Toder | 206/343 X |
| 4,417,656 | 11/1983 | Kato | 40/24 |
| 4,534,464 | 8/1985 | Lankton | 40/24 |

*Primary Examiner*—Robert Peshock

*Assistant Examiner*—J. Hakomaki

*Attorney, Agent, or Firm*—Biebel, French & Nauman

[57] ABSTRACT

An assembly of tag pins is provided with a removable cap over the heads of the pins, thereby preventing any entwinement between heads which may arise when a plurality of assemblies have been packed. The cap is formed of a soft and thin synthetic resin, in one case integral with an assembly of tag pins, and has a cross-section " " shape defining a space receiving heads of the assembly of tag pins and having an opening at one side thereof. A connection between the cap and the assembly of tag pins is formed at only two positions, that is, respective top portions of longitudinal outermost heads of the assembly, thus the cap can be easily removed because it has sufficiently flexibility to be deformed and can be easily widened by the fingers of a user. Alternatively, the cap is independently formed from the assembly of tag pins, and a connection between the cap and the assembly is formed during the capping of the assembly, or the cap may have no connection with the assembly of tag pins, in which case the cap can be easily removed by simply sliding it longitudinally or laterally along the assembly of tag pins. In this case the cap has a cross-section or longitudinal section " " shape fully opened at transversal or longitudinal sides thereof, respectively, and also includes inner flanges extended inwardly from respective lower ends of both side walls thereof, the flange acting to support the cap on heads of the assembly.

8 Claims, 5 Drawing Figures

ASSEMBLY OF TAG PINS WITH A CAP AVOIDING AN ENTWINEMENT BETWEEN HEADS

BACKGROUND OF THE INVENTION

The present invention relates to an assembly of tag pins, and in particular, an assembly of tag pins provided with a cap avoiding an entwinement between heads.

In order to attach a label to a garment or other article, a label-attaching member, i.e., tag pin is generally utilized. Such tag pin which is made of a synthetic resin comprises a head having various shapes and a cross bar joined to said head by a filament. To be continuously supplied into a tag pin-attaching device, individual tag pins are connected together in a line and spaced uniformly from each other by means of a connecting bar to form an assembly of tag pins. For attaching a label to a garment or other article, an assembly of tag pins is inserted into a tag pin-attaching device. Then, a needle of the device is penetrated into the article to be labeled. Thereafter, pulling a handle of the device results in a partial cutting of the connecting bar, so that individual tag pins are separated from the assembly thereof one by one. Simultaneously, a cross bar of the separated tag pin is penetrated into the article to be labeled. Thus, each tag pin is firmly held on the article.

Individual filaments are connected together to the connecting bar such that they are extended in parallel. Although having a certain firmness after forming in a mould, each filament becomes thin and soft after a stretching thereof. Due to each flexibility of filaments, there is a problem of tangling heads occuring when a plurality of assemblies of tag pins have been packed. Such entwinement between heads results in a time consuming effort to untangle them and doesn't contribute to the continuity and efficiency of a tag pin-attaching operation.

To eliminate such problem, several improved constructions of tag pins have been proposed. For example, the U.S. Pat. No. 3,733,657 discloses an assembly of tag pins wherein in addition to the connection provided at a lower end of each filament, a connection is provided at an upper end thereof, that is, between adjacent heads by means of a thin connecting member, in order to avoid any entwinements between heads. In this construction, however, it is difficult to manufacture a mould for integrally forming thin connecting members with an assembly of tag pins. On the other hand, connecting members may be subject to torsional stress, in stretching an assembly of tag pins. This causes connecting members to have a toughness which makes a cutting of connecting members to be difficult.

The Korean Utility Model Publication No. 83-1213 discloses an assembly of tag pins wherein adjacent heads are connected by a very small connecting point at respective outer corners of respective one upper end thereof. This construction also encounters a problem of tangling heads. This is due mainly to the weak linkage at the connecting point, where the connecting point may easily break when an assembly of tag pins is stretched, so that adjacent heads are separated from each other, causing an entwinement therebetween. In this construction, a problem in manufacturing a mould is also encountered. In addition, there is a disadvantage that a connection between adjacent heads has to be removed in using an assembly of tag pins.

SUMMARY OF THE INVENTION

Accordingly, an object of the present invention is to provide an assembly of tag pins having an improved construction which eliminates a problem of tangling heads.

This object is accomplished, according to the present invention, by providing an assembly of tag pins provided with a cap adapted to avoid an entanglement between heads.

According to the present invention, the cap functions to cap a group of heads of an assembly of tag pins, thereby enabling to effectively prevent any entwinement between heads which may arise when a plurality of assemblies have been packed. The cap is later removed, when using the assembly of tag pins.

An aspect of the present invention, a cap integrally formed with an assembly of tag pins. In this case, the cap has a cross-section "  " shape defining a space receiving a group of heads of the assembly of tag pins and having an opening at one side thereof. And also, a connection between the cap and the assembly of tag pins is formed at only two positions, that is, respective top portions of longitudinal outermost heads of the assembly. Accordingly, a removal of cap from the assembly can be easily carried out.

According to other aspects of the present invention, a cap is independently formed from the assembly of tag pins. In this case, a connection between the cap and the assembly of tag pins may be formed during the capping of the assembly of tag pins. Alternatively, the cap may be constructed to have no connection with the assembly of tag pins. In this case, the cap can be easily removed by simply sliding longitudinally or laterally along the assembly of tag pins. To this end, the cap has a cross-section or longitudinal section "  " shape fully opened at transversal or longitudinal sides thereof, respectively. The cap also includes inner flanges extended inwardly from respective lower ends of both side walls thereof. The inner flange is adapted to support the cap on heads of the assembly. In the case that the cap is laterally slideable along the assembly, particularly, the cap may include a plurality of head-supporting members formed on the inner surface of top wall thereof.

The removal of cap can be more easily carried out, in view of the fact that the cap is made of a soft and thin synthetic resin having a thickness of less than 0.5 mm, in accordance with the present invention. That is, the cap has a sufficient flexibility to become easily deformed by itself such that an opening of cap can be easily widened by a force of fingers of a user.

As above-mentioned, the present invention perfectly eliminates a problem of tangling heads encountered in the prior arts, by providing an improved assembly of tag pins having a cap with simple construction and enabled a simple and easy removal. In accordance with the present invention, therefore, tag pin-attaching operation can be efficiently and continuously carried out, without any entwinement between heads of the assembly. Thus, the assembly of tag pins with a cap according to the present invention is the one having a high utility.

Other objects and advantages of the present invention will be apparent from the following description taken in conjunction with the accompanying drawing.

DESCRIPTION OF THE PREFERRED EMBODIMENTS

Figure 1:
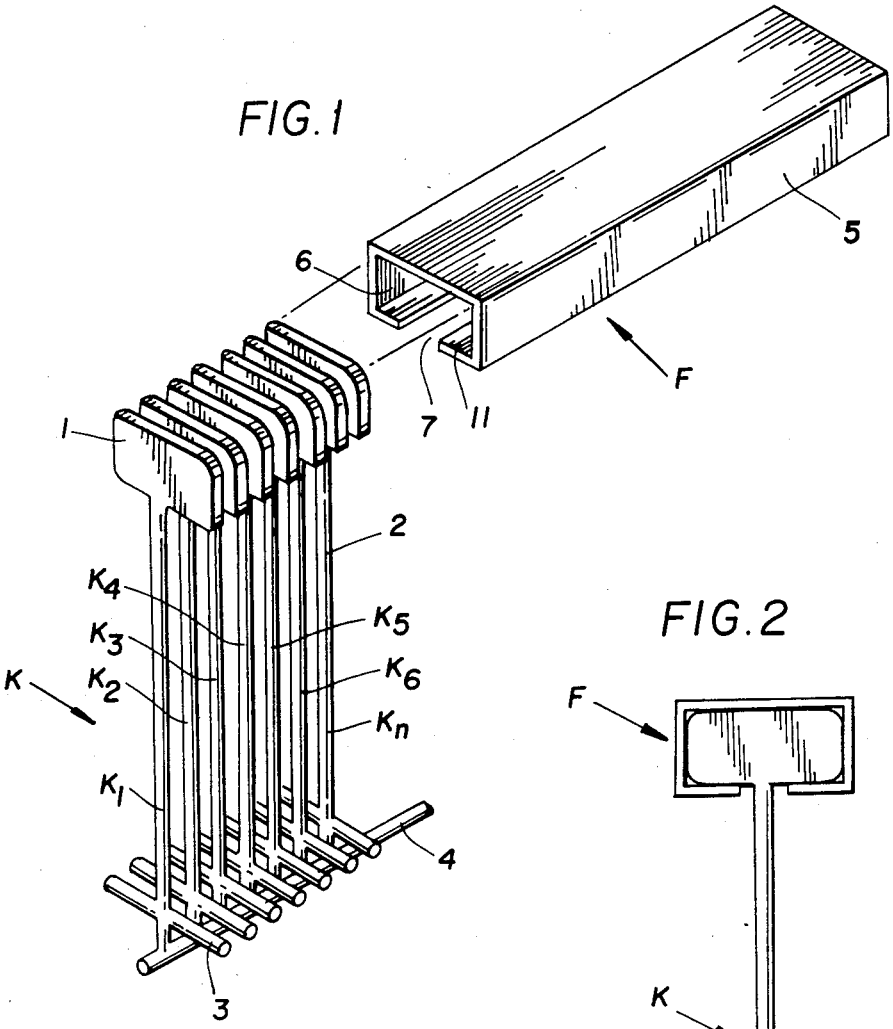
FIG. 1 is an exploded perspective view of an assembly of tag pins having a cap according to an embodiment of the present invention.

FIG. 1 is an exploded perspective view showing an assembly of tag pins with a cap F-1 adapted to avoid any entwinements between heads, in accordance with the present invention. Each tag pin K conventionally comprises a head 1 which may have various shapes, a thin and long filament 2 connected at an upper end thereof to said head, and a transversally extended-cross bar 3 connected to a lower end of said filament. Individual tag pins are integrally connected together in a line and uniformly spaced from each other by means of a connecting bar 4, to form an assembly of tag pins. This assembly of tag pins is made of a soft synthetic resin. According to the present invention, the illustration F-1 comprises a body 5 made of a longitudinally extended-rectangular box. The illustrated body 5 has a cross-section " " shape defining a rectangular space 6 adapted to receive a group of heads of the assembly of tag pins at the interior thereof. The space 6 is opened at both longitudinal ends of the cap F-1, to allow a capping or removal of cap by longitudinally sliding it along a group of heads. The body 5 has two inner flanges 11 extended inwardly from both lower ends of side walls thereof throughout a length thereof. Inner flanges 11 define an opening 7 therebetween through which the filaments extend and function to support the cap F on a group of heads. The opening 7 may be utilized as an opening through which a group of heads is removed from the space 6, as described hereinafter.

According to the present invention, the cap F-1 is made of a thin and soft synthetic resin having a thickness of less than 0.5 mm. Accordingly, the cap F-1 has a sufficient flexibility to become easily deformed by itself such that the opening 7 can be easily widened by a force of fingers of a user. For instance, the opening 7 is easily widened, as a user simply pushes up the cap F-1 from the assembly of tag pins. Then a group of heads 1 are easily extracted from the space 6, so that a removal of the cap F can be easily accomplished.

Figure 2:
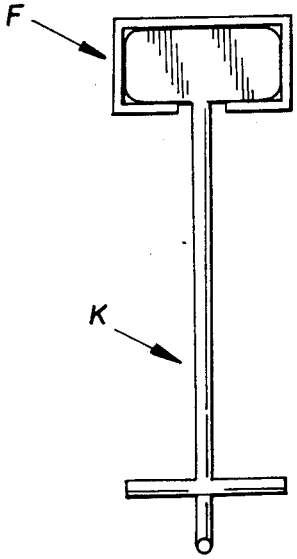
FIG. 2 is a side view of an assembly of tag pins shown in FIG. 1.

FIG. 2 shows the assembly of tag pins in which a group of heads are capped with the cap F-1.

Figure 3:
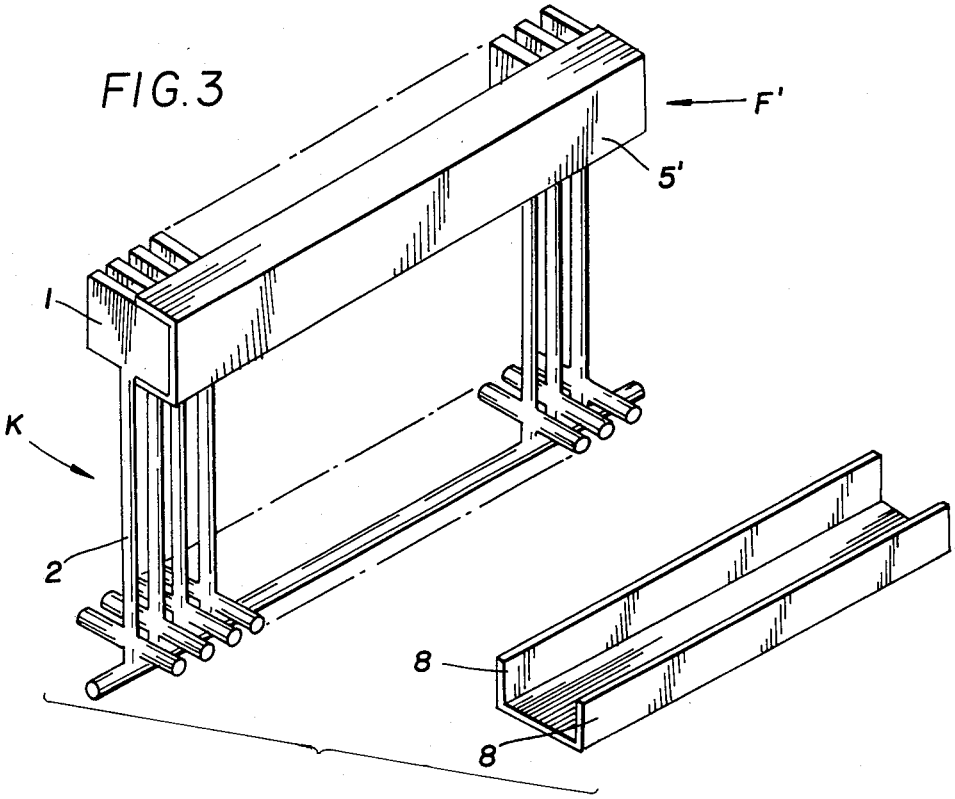
FIG. 3 is a perspective view of an assembly of tag pins having a cap according to another embodiment of the present invention.

FIG. 3 shows an assembly of tag pins having a cap F-2 constructed according to another embodiment of the present invention. In this embodiment, the construction of tag pin is identical to that of tag pin according to the afore-mentioned embodiment, so that a description thereof is omitted herefrom. While the cap F-1 of FIG. 1 encloses fully a group of heads, the cap F-2 is constructed to partially enclose a group of heads. That is, the cap F-2 comprises a body 5' having a cross-section " " shape opened at one side thereof. The body 5 includes upper and bottom walls 8 extending in paralled with a uniform space therebetween and functioning as a supporting member which supports the cap F-2 around a group of heads 1.

The cap F can be easily engaged with or removed from a group of heads by sliding it laterally along said heads.

Figure 4:
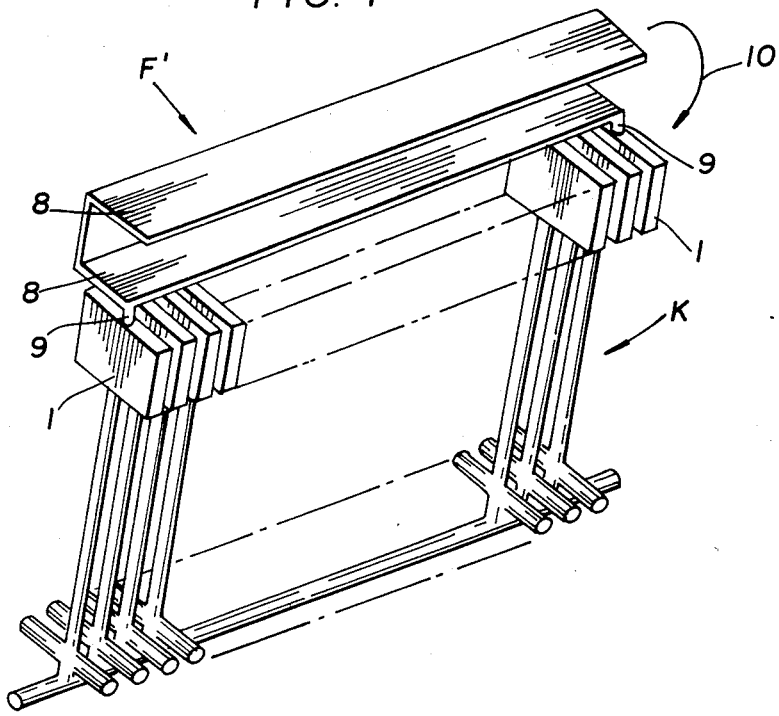
FIG. 4 is a perspective view of an assembly according to another embodiment of the present invention.

FIG. 4 shows an assembly of tag pins with a cap having a modified construction from that of FIG. 1, according to another embodiment of the present invention. As different from the embodiment of FIG. 3 wherein the cap F-2 engages with a group of heads, which may have various shapes, by sliding along said heads, this embodiment provides a connection between the cap and the assembly of tag pins. Such connection is obtained by a pair of connecting members 9 provided at respective top portions of longitudinal outermost heads of the assembly. To provide the above-mentioned connection, the cap F-3 may be integrally formed with the assembly of tag pins. However, the provision of the connection between the cap and the assembly does not make the manufacture of a mould difficult, in view of the fact that the connection is required at only two positions. In this construction, the cap F-3 is engaged with a group of heads 1, by pushing down and pivoting the cap F-3 about the connecting members 8 in a direction indicated by a reference numeral 10 in FIG. 4.

Figure 5:
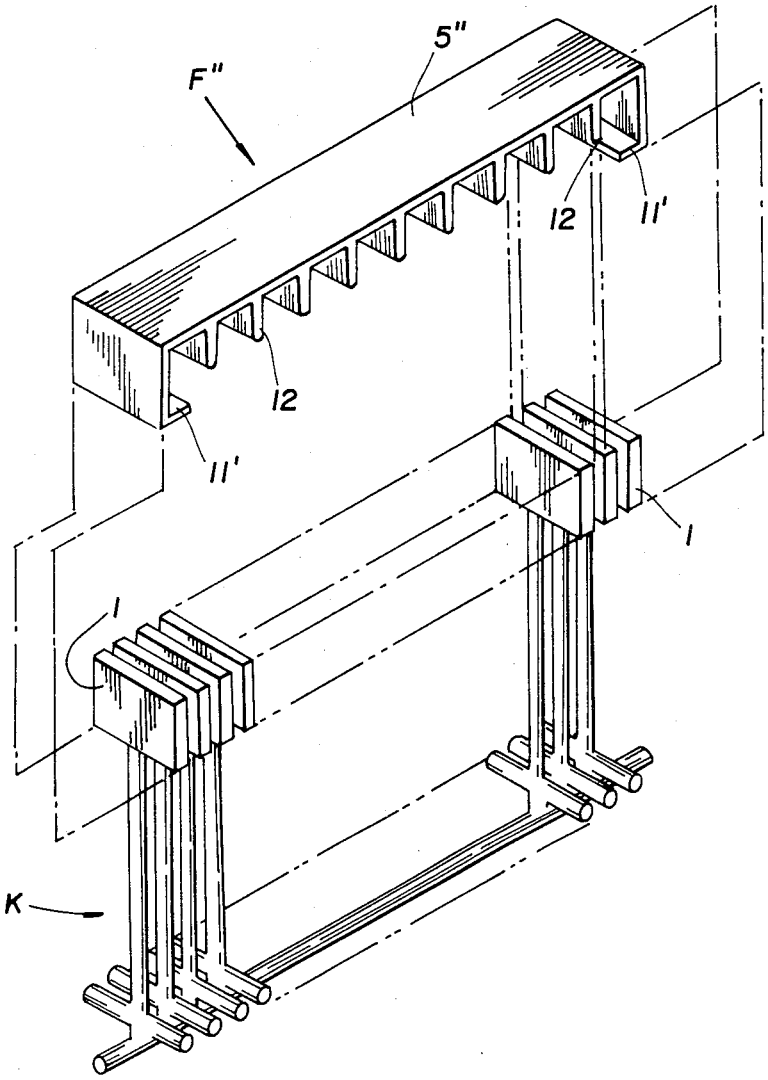
FIG. 5 is a perspective view of an assembly according to another embodiment of the present invention.

FIG. 5 shows an assembly of tag pins provided with a cap according to another embodiment of the present invention. In this illustrated embodiment, the construction of tag pin K is identical to that of tag pin of FIG. 1, so that a description thereof is omitted herefrom. According to this embodiment, the cap F-4 is made of soft and thin synthetic resin and comprises a body 5" having a longitudinal-section " " shape fully opened at both longitudinal sides thereof. The body 5" also includes inner flanges 11' extended inwardly from respective lower ends of both longitudinal end walls thereof. The inner flanges 11' are adapted to support the cap F-4 on illustrated heads 1 of the assembly. The cap F includes a plurality of head-supporting members 12 extended downwardly from the inner surface of top wall thereof and uniformly spaced from each other. The cap F-4 can be easily engaged with and removed from a group of heads, by laterally sliding it along the heads 1. When the cap F-4 is engaged with a group of heads 1, each head-supporting member 12 fits into a space between adjacent heads 1, thereby preventing effectively any entwinement between heads.

According to the present invention, an assembly of tag pins is stretched and packed under conditions where heads 1 are capped with a cap. Accordingly, there is no entwinement between heads, in stretching and packing the assembly of heads 1.

The cap may be removed from the assembly of tag pins K, in using the assembly. The removal of cap can be easily carried out, in view of the fact that the caps are made of a thin and soft synthetic resin. That is, due to the flexibility, the caps can be easily deformed and thus removed from heads, as a user simply pushes up the cap from the assembly of tag pins. Where the cap is constructed to slide laterally or longitudinally along the heads, a removal of the cap can be easily carried out, by simply sliding it by using fingers of a user. Where the cap is able to longitudinally slide along a group of heads, particularly, a tag pin-attaching operation may be carried out, without removing the cap from the assembly of tag pins. This is because individual tag pins are naturally and slideably extracted from the cap one by one, as the tag pin-attaching operation is advanced.

As described here in before, an assembly of tag pins is stretched, packed, and handled, at a condition that the cap encloses a group of heads. In stretching and handling the assembly, accordingly, there is no entwinement between heads as encountered in the prior art providing a weak connecting point between adjacent heads, as described above. According to the present invention, therefore, tag pin-attaching operation can be efficiently and continuously carried out. In addition, there are no troublesome mishaps of forcedly breaking a plurality of connecting members or points every time as in the prior arts.

What is claimed is:

1. An assembly of tag pins comprising:

a plurality of tag pins made of a soft synthetic resin, each tag pin including a generally flat head, a thin and long filament operatively connected at an upper end thereof to said head, and a transversely extended-cross bar operatively connected to a lower end of said filament, a connecting bar integral with and connecting said tag pins together in a line in uniformly spaced parallel relation to each other to form the assembly of tag pins, and a cap of deformable material for surrounding at least a portion of each of the heads of the assembly, said cap consisting of a body made of a longitudinally extended box and having a generally C-shaped cross section and including a base and side walls extending outwardly therefrom defining a space for receiving the heads of the assembly at the interior thereof, said space being fully opened at both longitudinal ends thereof in order to slideably receive and extract a group of heads of the assembly.

2. An assembly of tag pins according to claim 1, wherein the cap comprises a body having an open C-shaped cross-section corresponding to one side of each of the heads, said body including upper and bottom walls extending in parallel with a uniform space therebetween corresponding to the height of the caps and functioning as a member supporting the cap along one side of a group of heads of the assembly, so that the cap can be slideably engaged with either a right or left half of said group of heads.

3. An assembly of tag pins according to claim 2, wherein the cap is integrally connected with the assembly by means of two flexible connecting members provided at respective top portions of longitudinal outermost heads of the assembly.

4. An assembly of tag pins according to claim 1, wherein the cap comprises a body having a generally elongated C-shape in longitudinal-section fully opened at both longitudinal sides thereof, a pair of inner flanges extended inwardly from respective lower ends of both longitudinal end walls thereof, and a plurality of head-supporting members extended downwardly from the inner surface of top wall thereof and uniformly spaced from each other.

5. An assembly of tag pins according to claim 1, wherein a pair of inner flanges extend inwardly from the ends of both side walls of said body, respectively, throughout a length of said body, said flanges defining an opening therebetween through which the filaments of the assembled tags extend.

6. An assembly comprising:

a plurality of like tag pins made of a soft synthetic resin, each tag pin including as integral parts a generally flat head, a thin and long filament connected at an upper end thereof to said head, and a transversely extending cross bar connected to a lower end of said filament;

a connecting bar integral with each of said tag pins near said cross bar and connecting said tag pins together in a line in uniformly spaced relation to each other with said heads parallel to form the assembly of tag pins; and a cap of soft deformable synthetic resin surrounding at least a common portion of the heads of the assembly, said cap comprising:

an open ended body in the form of a longitudinally extended box having a generally C-shaped cross-section including a base and side walls extending outwardly therefrom defining a space dimensioned to receive the heads of the assembly within the interior thereof but allowing the pin heads to be slideably received into and extracted therefrom.

7. An assembly, comprising:

a plurality of stretched tag pins made of synthetic resin, each tag pin including a head, a transversely extending cross bar, and a long filament connected at its one end to said head and at its other end to said cross bar, and a connecting bar connected integrally to each cross bar to connect said tag pins together in a line and in longitudinally spaced relation to each other; and a longitudinally extending cap for embracing and capturing said heads to prevent tangling, said cap having a generally C-shaped cross-section and defining space for receiving said heads and temporarily confining said heads within the space, and said cap having an open end to enable said heads to be slidably received into and extracted from said cap.

8. A method for assembling a plurality of tag pins made of synthetic resin, each tag pin including a head, a transversely extending cross bar, and a long filament connected to its one end of said head and its other end to said cross bar, and a connecting bar integrally connected to each cross bar to connect said tag pins together in a line and in longitudinally spaced relation to each other such that the heads of the tag pins do not become entangled comprising the steps of:

producing an assembly of said tag pins;

producing a means for confining the heads of said assembly of tag pins such that said tag pin heads will not become entwined;

inserting the plurality of tag pin heads into said confining means such that said tag pin heads are restricted thereby and said tag pin heads do not become entangled either with the same assembly or when packed with other tag pin assemblies.

* * * * *

UNITED STATES PATENT AND TRADEMARK OFFICE

CERTIFICATE OF CORRECTION

PATENT NO. : 4,633,605

DATED : January 6, 1987

INVENTOR(S) : Young W. Kang

It is certified that error appears in the above-identified patent and that said Letters Patent are hereby corrected as shown below:

In the drawings

In Fig. 1, F should be --F-1--;

In Fig. 2, F should be --F-1--;

In Fig. 3, F' should be --F-2--;

In Fig. 4, F' should be --F-3--;

In Fig. 5, F" should be --F-4--.

In the Abstract

Line 8 after "section' --"⌐¬" omitted;

Line 24 after "section" --"⌐¬" omitted.

In the Specification

Column 2, line 20 after "cross-section" --"⌋ "-- omitted;

Column 2, line 38 after "section" --"⌐¬"-- omitted;

Column 3, line 30 "illustration" should be --illustrated--;

Column 3, line 33 after "cross-section" --"⌐¬"-- omitted;

Column 3, line 67 after "cross-section" --" ⌋ "-- omitted;

UNITED STATES PATENT AND TRADEMARK OFFICE

CERTIFICATE OF CORRECTION

PATENT NO. : 4,633,605

DATED : January 6, 1987

INVENTOR(S) : Young W. Kang

It is certified that error appears in the above-identified patent and that said Letters Patent is hereby corrected as shown below:

Column 4, line 34, "longitudinal-section" --"⌐¬ "--
Omitted.

Signed and Sealed this

First Day of September, 1987

*Attest:*

*Attesting Officer*

DONALD J. QUIGG

*Commissioner of Patents and Trademarks*